US006769868B2

(12) United States Patent
Harrold

(10) Patent No.: US 6,769,868 B2
(45) Date of Patent: Aug. 3, 2004

(54) STATOR VANE ACTUATOR IN GAS TURBINE ENGINE

(75) Inventor: Michael Charles Harrold, Newburyport, MA (US)

(73) Assignee: General Electric Company, Schenectady, NY (US)

( * ) Notice: Subject to any disclaimer, the term of this patent is extended or adjusted under 35 U.S.C. 154(b) by 51 days.

(21) Appl. No.: 10/209,244

(22) Filed: Jul. 31, 2002

(65) Prior Publication Data

US 2004/0022624 A1 Feb. 5, 2004

(51) Int. Cl.[7] ..... F01D 17/16
(52) U.S. Cl. ..... 415/150; 415/159; 415/162
(58) Field of Search ..... 415/149.4, 150, 415/159, 162, 1; 29/889.21, 889.22

(56) References Cited

U.S. PATENT DOCUMENTS 3,458,118 A * 7/1969 Burge et al. ..... 415/149.4
3,487,992 A 1/1970 Pineda ..... 230/114
3,614,253 A 10/1971 Gaertner ..... 415/23
3,779,665 A * 12/1973 Tatem et al. ..... 415/123
3,873,230 A 3/1975 Norris et al. ..... 415/162
4,295,784 A 10/1981 Manning ..... 415/162
4,409,788 A 10/1983 Nash et al. ..... 60/226.3
4,720,237 A 1/1988 Weiner et al. ..... 415/150
4,755,104 A 7/1988 Castro et al. ..... 415/136
5,549,448 A 8/1996 Langston ..... 415/149.4

* cited by examiner

*Primary Examiner*—Edward K. Look
*Assistant Examiner*—Dwayne J. White
(74) *Attorney, Agent, or Firm*—William Scott Andes; Gregory A. Welte

(57) ABSTRACT

An actuator for adjustable stator vanes in a gas turbine engine. A torque tube is rotatable about its axis, and supports devises which connect to links. The links are connected to rings, and rotate the rings when the torque tube rotates, thereby adjusting stator vanes connected to the rings. A linear actuator, having a motion axis parallel to the torque tube, drives the torque tube, through a linear-rotary convertor. The invention occupies less space on the engine, and requires no adjustment of the linear-rotary convertor after installation.

18 Claims, 16 Drawing Sheets

STATOR VANE ACTUATOR IN GAS TURBINE ENGINE

TECHNICAL FIELD

The invention concerns actuation systems which rotate stator vanes in gas turbine engines.

BACKGROUND OF THE INVENTION

The compressor in the modern axial-flow gas turbine engine is commonly equipped with variable stator vanes. FIGS. 1 and 2 illustrate the function of the stator vanes. They are views from outside a compressor having transparent walls, looking toward the axis of rotation, and looking at the tips of the blades.

These Figures are not drawn to scale, and are not aerodynamically accurate in detail. They are presented solely to illustrate the principle of using stator vanes to change the angle-of-attack of incoming airstreams to a compressor stage located downstream of the stator vanes.

FIG. 1 illustrates two stages 3 and 6 of a compressor. Incoming air, travelling in the direction of vector 9, is compressed by the first stage 3. Vector 9 is drawn as horizontal on the page. However, the direction of air actually seen by the first stage 3 is the vector sum of (1) vector 9 and (2) the velocity of the stage 3. Vector 12 represents the velocity, and vector 15 represents the vector sum.

Vector 15 represents a particular angle-of-attack at which the first stage 3 encounters the incoming air 9. After the first stage 3 compresses the air it discharges it in a different direction, represented by vector 18. Not only will vector 18 lie in a different direction than vector 9, but its velocity will be greater, because of the compression process. Vector 18 does not necessarily represent an optimal angle-of-attack for the second stage 6.

Variable stator vanes provide a solution. If variable stator guide vanes 24 are provided, as in FIG. 2, vector 18 of FIG. 1 can be changed to vector 18A of FIG. 2, having the correct angle-of-attack. The Inventor points out that the stator vanes 24 do not rotate along with stages 3 and 6. They are stationary, although individual vanes may pivot, as will now be explained.

Many types of stator vanes are adjustable, in order to adjust the angle-of-attack seen by the compressor stage to which the stator vanes deliver discharge air. For example, they may pivot about axis 26, as indicated by arrows 27.

FIG. 3 illustrates one mechanism for adjusting the stator vanes, and FIG. 4 illustrates many of the components of FIG. 3 in simplified, schematic form. Axes 26 in FIGS. 3 and 4, namely, the axes about which stator vanes 24 pivot, correspond to axis 26 in FIG. 2. A lever 36 is connected to each stator vane. All levers for a given stage of stator vanes are connected to a movable ring, such as rings 39 and 42 in FIG. 3. FIG. 4 shows ring 39.

Each ring is rotated about axis 45, to thereby rotate its stage of stator vanes. A bell crank, such as bell crank 48, rotates each ring. For example, when bell crank 48 rotates about axis 49 in FIG. 4, link 51 causes ring 39 to rotate about axis 45. Crank 36 thus rotates about axis 26, thereby rotating the stator vane 24.

All bell cranks are constrained to move in unison, by connection to arm 54. An actuator 60, described below, moves the bell cranks in unison, through a linkage represented by arrow 63 in FIG. 5.

The Inventor has identified an improvement to this type of construction.

SUMMARY OF THE INVENTION

In one form of the invention, a mechanical actuator which adjusts positions of adjustable stator vanes in a gas turbine engine occupies a sector of reduced size on the circumference of the engine, compared with the prior art.

DETAILED DESCRIPTION OF THE INVENTION

Figure 5:
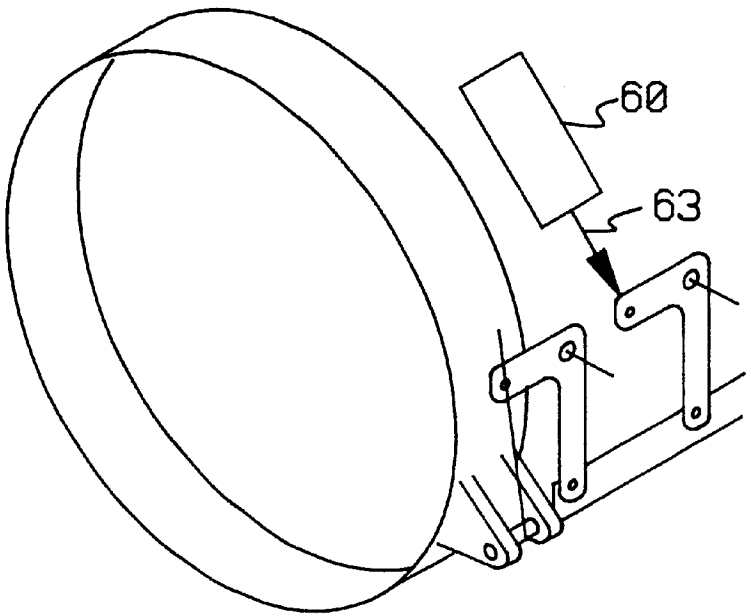
FIG 5 PRIOR ART
FIGS. 5 and 6 illustrate a tangentially mounted actuator 60 as found in the prior art.

One problem which the Inventor has identified in the system described above is illustrated in FIG. 6. When the hydraulic actuator 60 is positioned in the tangential position shown in FIG. 5, several phenomena occur which may not be desirable. One is that stack-up tolerances cause errors in positioning, which must be removed by adjustment after installation.

Figure 6:
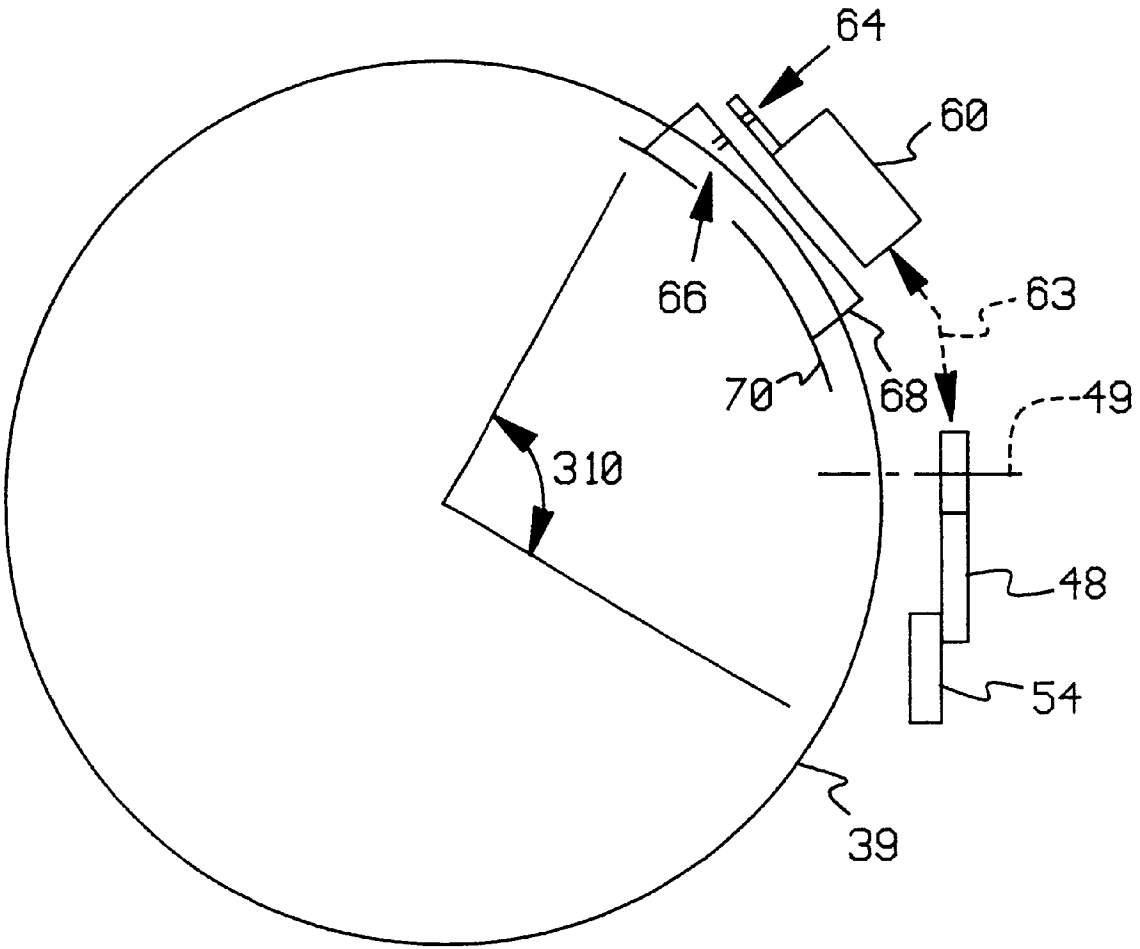

For example, bolt holes 64 in FIG. 6 in the mounting plate of actuator 60 are designed to be located in specific positions, as are bolt holes 66 with which they mate. However, because of unavoidable manufacturing tolerances, both sets of holes will be slightly mislocated. Further, the position of axis 49 will also be slightly mis-located, for similar reasons. Also, the components which make up linkage 63 will also suffer small dimensional errors.

Consequently, the variable stator vanes will be slightly displaced from their intended, designed positions. As a specific example, if actuator 60 is a hydraulic piston, the system would be designed so that, when the piston 60 is retracted at its farthest position, the stator vanes will assume a specific angle. In practice, that angle, under that piston condition, will be slightly in error.

Therefore, various adjustments must be made after installation of the actuator 60. These adjustments consume the time of installation technicians.

In addition, the mounting platform 68 for the actuator 60 can be connected to a different component entirely than the mount (not shown) which supports bell crank 48. The interconnection of those two components can also suffer the stack-up problems just described.

In addition to the stack-up problems just described, the configuration of FIG. 6 possesses another characteristic. In operation, the casing 70 which supports the mounting platform 68 will change in size, due to temperature changes. This change alters the distance between the actuator 60 and the bell cranks 48, and at least two alterations occur. One results from the change in the diameter of casing 70. Another results from the change in axial length, that is, a change in distance along axis 45 in FIG. 4. These changes alter the transfer function, or gain, of the system.

Figure 7:
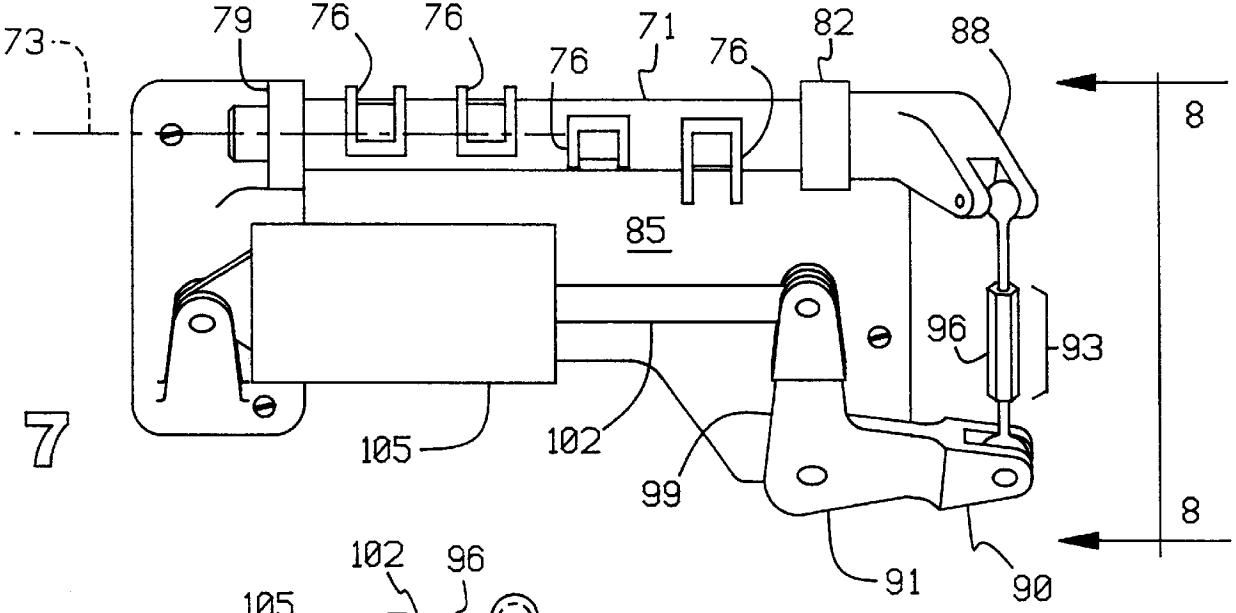
FIG. 7 illustrates one form of the invention.
Figure 9:
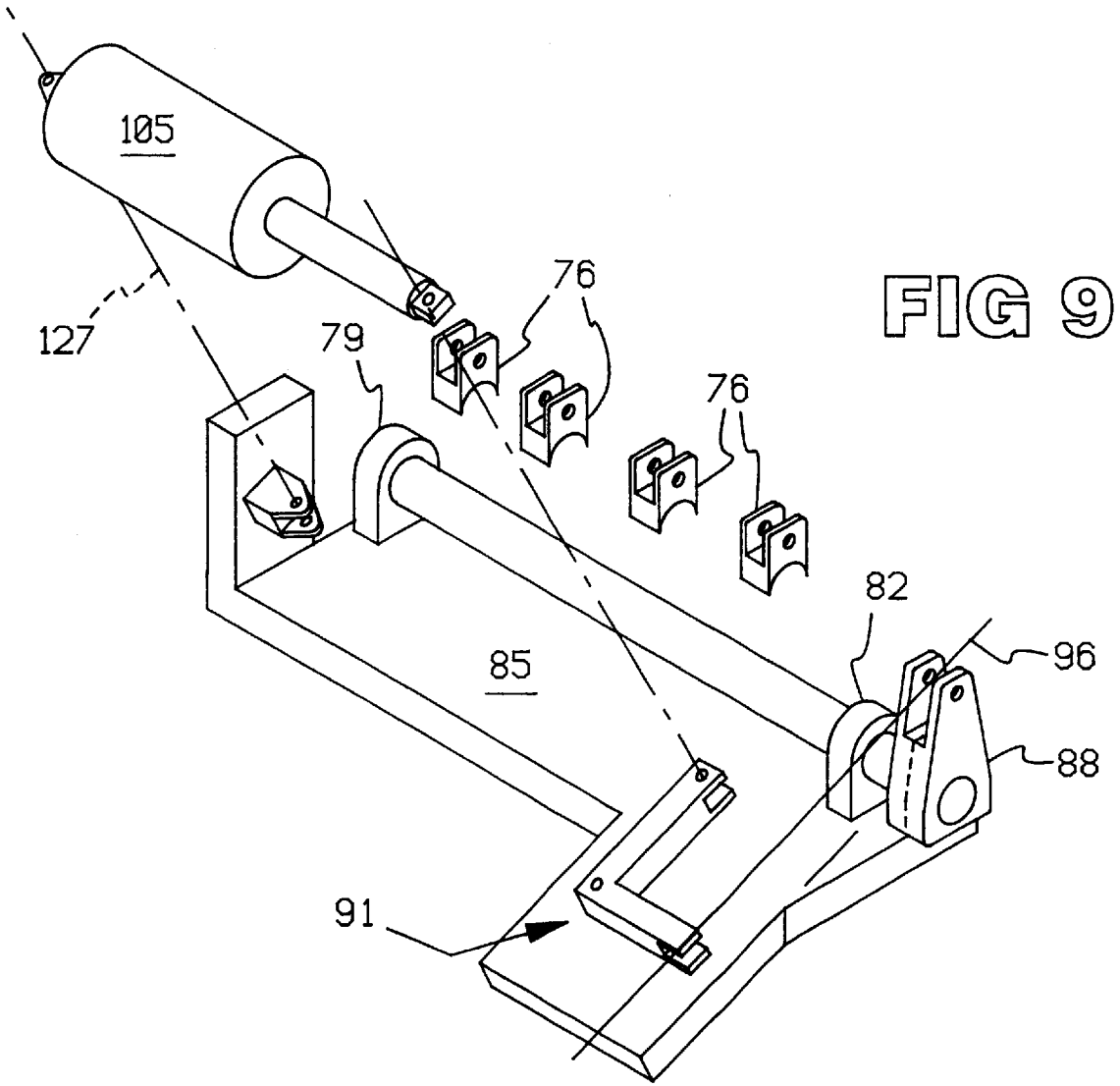
FIGS. 9, 10, 11, and 22 are simplified perspective views of the apparatus of FIG. 7, with various features emphasized.

The invention mitigates, or removes, many of these characteristics, by utilization of the apparatus shown in FIG. 7, which is shown in simplified perspective view in FIG. 9. FIG. 7 contains a torque tube 71, which rotates about axis 73. Four devises 76 are fastened to the torque tube 71. The devises are connected to links, such as link 51 in FIG. 4. Each link connects to a ring such as ring 39 shown in FIG. 4.

The torque tube 71 is supported by bearings 79 and 82, which are, in turn, supported by a base 85. A crank 88 is attached to the torque tube 71, and is connected to one arm 90 of a bell crank 91 by a link 93. A turnbuckle 96 allows adjustment of the length of the link 93.

The other arm 99 of the bell crank is connected to a rod 102, which is moved by a hydraulic actuator 105. The hydraulic actuator 105 pivots about axis 108.

All components shown in the Figure are supported, directly or indirectly, by the base 85. Several significant features of the apparatus of FIG. 7 will now be explained by reference to FIGS. 8–11.

Figure 10:
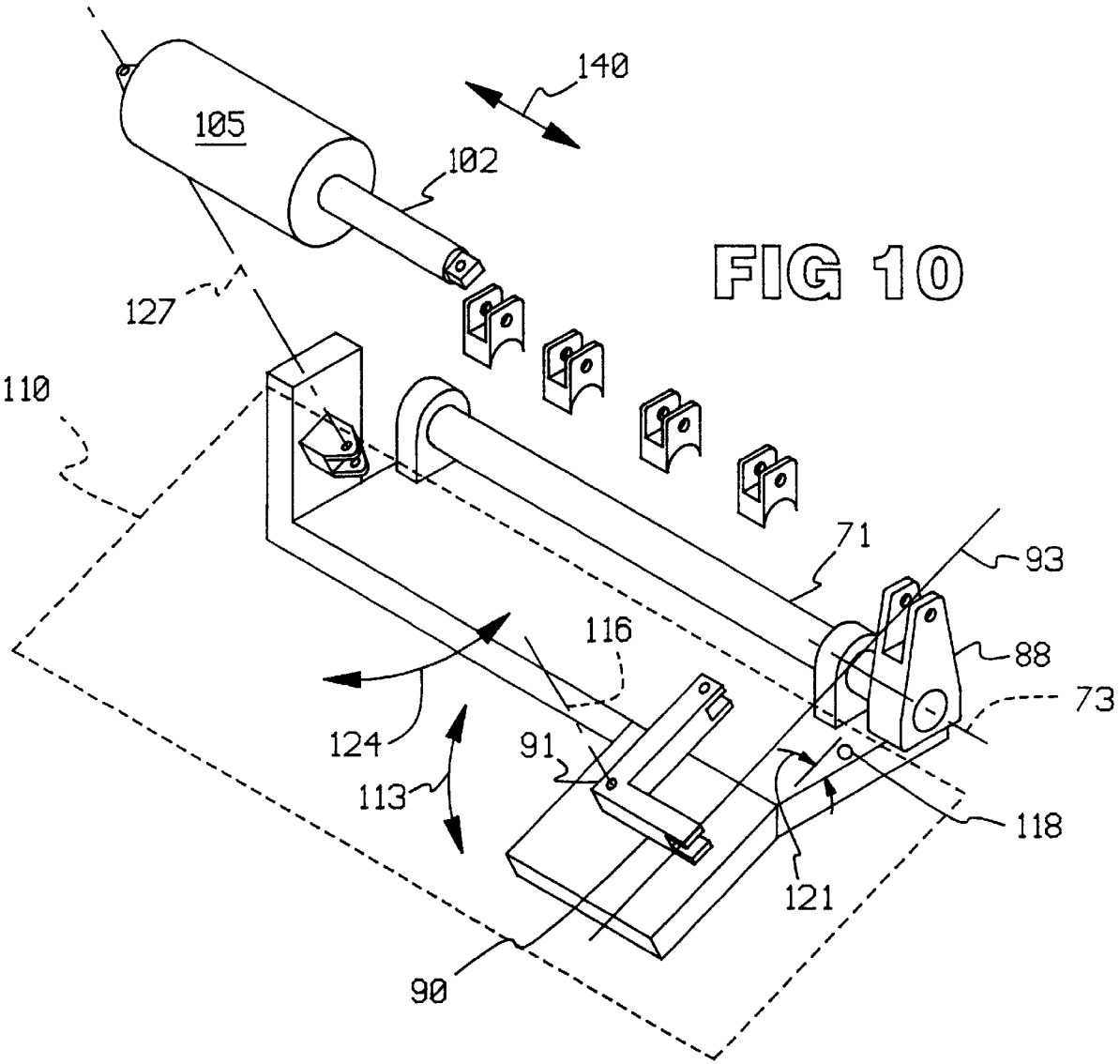

A geometric plane 110 is superimposed in FIG. 10. The bell crank 91 rotates within plane 110, as indicated by arrows 113, which are contained in plane 110. That is, axis 116 of bell crank 91 is perpendicular to plane 110. Plane 110 is inclined to the region 118 of base 85, as indicated by angle 121. The size of angle 121 will depend on the size of the engine to which the base 85 is applied, but an angle of about 30 degrees will be assumed herein, for convenience.

The hydraulic actuator 105 also moves in plane 110, as indicated by arrows 124. That is, during operation, the actuator 105 pivots about axis 127 of its mounting clevis 130. Any point on rod 102 sweeps out an arc represented by arrows 124. The arc lies in plane 110. Axis 127 is perpendicular to plane 110, and parallel to axis 116.

Therefore, three components remain within plane 110, or parallel to it, during operation. Hydraulic actuator 105 swings about axis 127. Rod 102 moves in the direction of arrows 140, but remains in the same plane, which is coincident, or parallel with, plane 110. Bell crank 91 rotates as indicated by arrows 113, and remains within plane 110.

Figure 11:
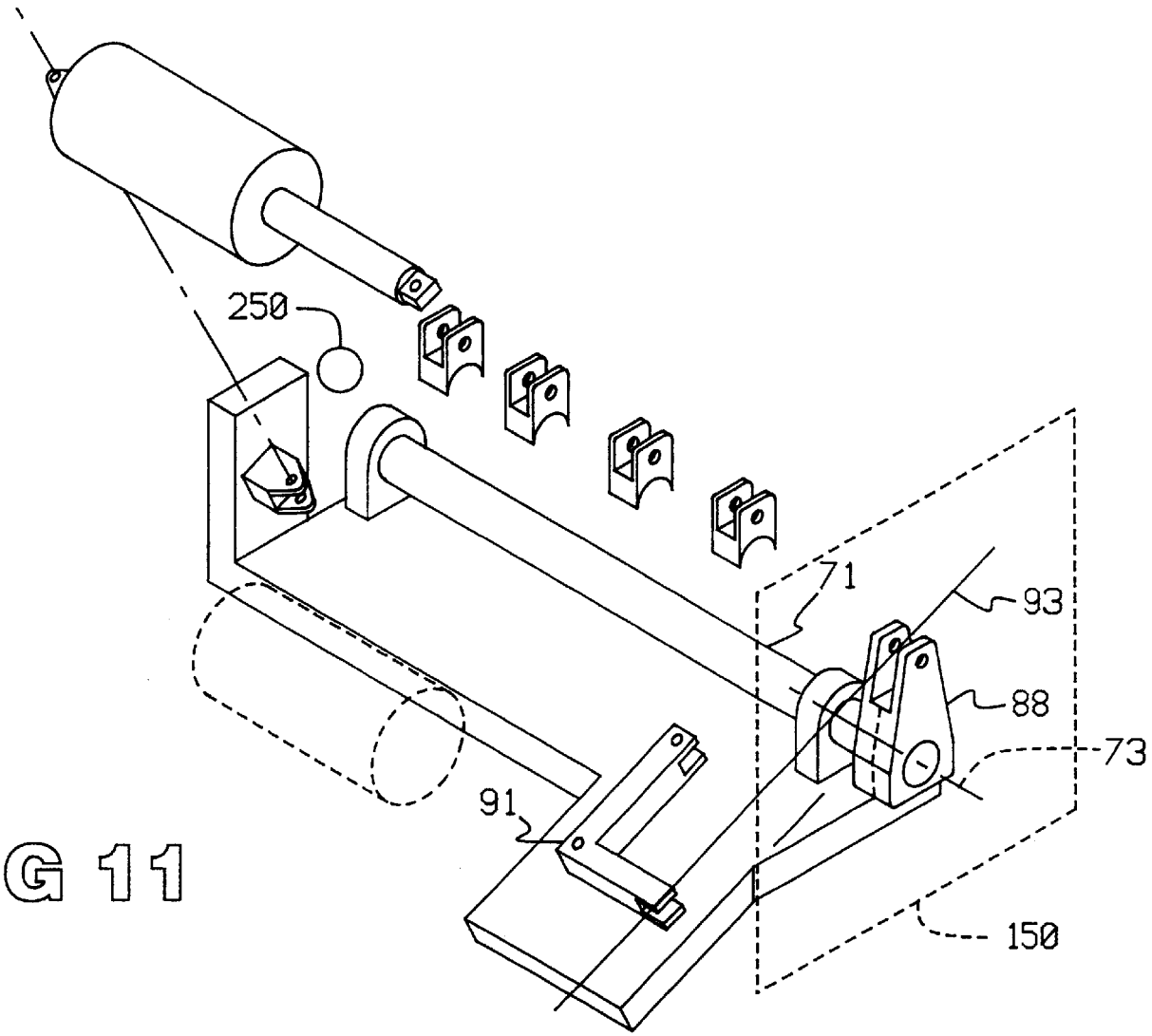
Figure 12:
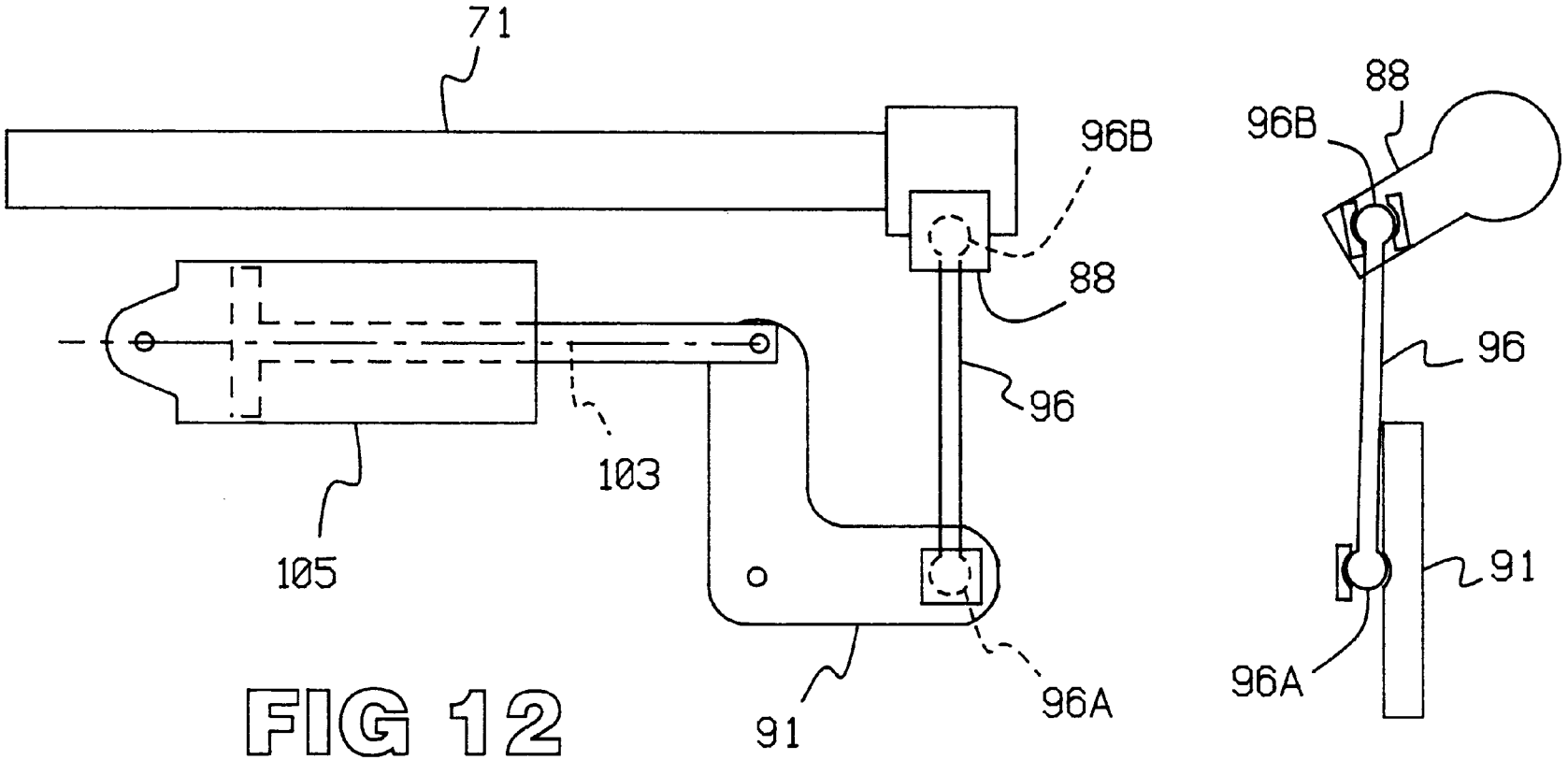
FIGS. 12 and 13 illustrate some characteristics of the motion experienced by several components of the invention.
Figure 13:
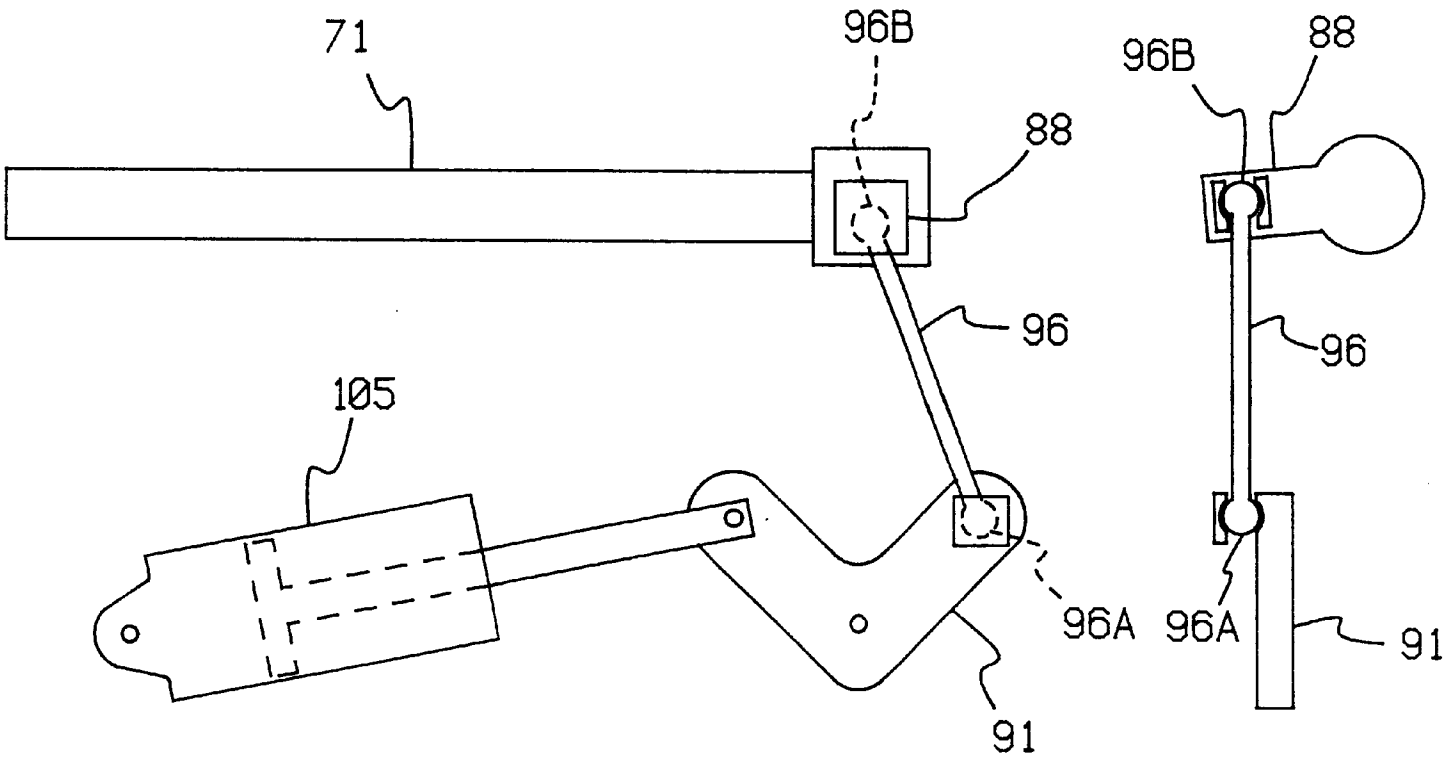

Other components move in a different plane. FIG. 11 shows plane 150, which is perpendicular to the axis 73 of torque tube 71. Crank 88 rotates in this plane 150. However, the link 93 which links crank 88 to the bell crank 91 does not remain in this plane 150, as indicated in FIGS. 12 and 13.

One can see that end 96A of link 96 remains in, or travels parallel to, plane 110 in FIG. 10. The other end 96B of link 96 remains in plane 150 in FIG. 11. However, the body of the link 96 follows a complex type of motion, and does not remain in a single plane, or follow a single axis.

Restated, end 96A traces an arc in plane 110 in FIG. 10. End 96B traces an arc in plane 150 in FIG. 11. Planes 110 and 150 are perpendicular to each other.

These structural relationships provide several advantageous features. One feature is that the direction of motion of the rod 102 of the hydraulic actuator 105 is parallel to axis 73 of the torque tube 71. In some situations, it may be desirable to move the actuator 105 to the position generally indicated by cylinder 175 in FIG. 11, in order to save space.

A second feature is that, once turnbuckle 96 in FIG. 7 is adjusted, the entire assembly of FIG. 7 can be installed onto an engine. No further adjustments to any linkages in that assembly are required, although adjustments of links 51 in FIG. 5 may be needed.

A third feature is that thermal changes in the dimensions of casing 70 in FIG. 6 have substantially no effect on the transfer function, or gain, between (1) axial position of the rod 102 in FIG. 7 and (2) angular position of the torque tube 71. A primary reason is that any such expansion merely moves base 85 in FIG. 7. However, that expansion fails to alter the relative dimensions between individual components supported on the base 85, such as rod 102 and torque tube 71.

Figure 14:
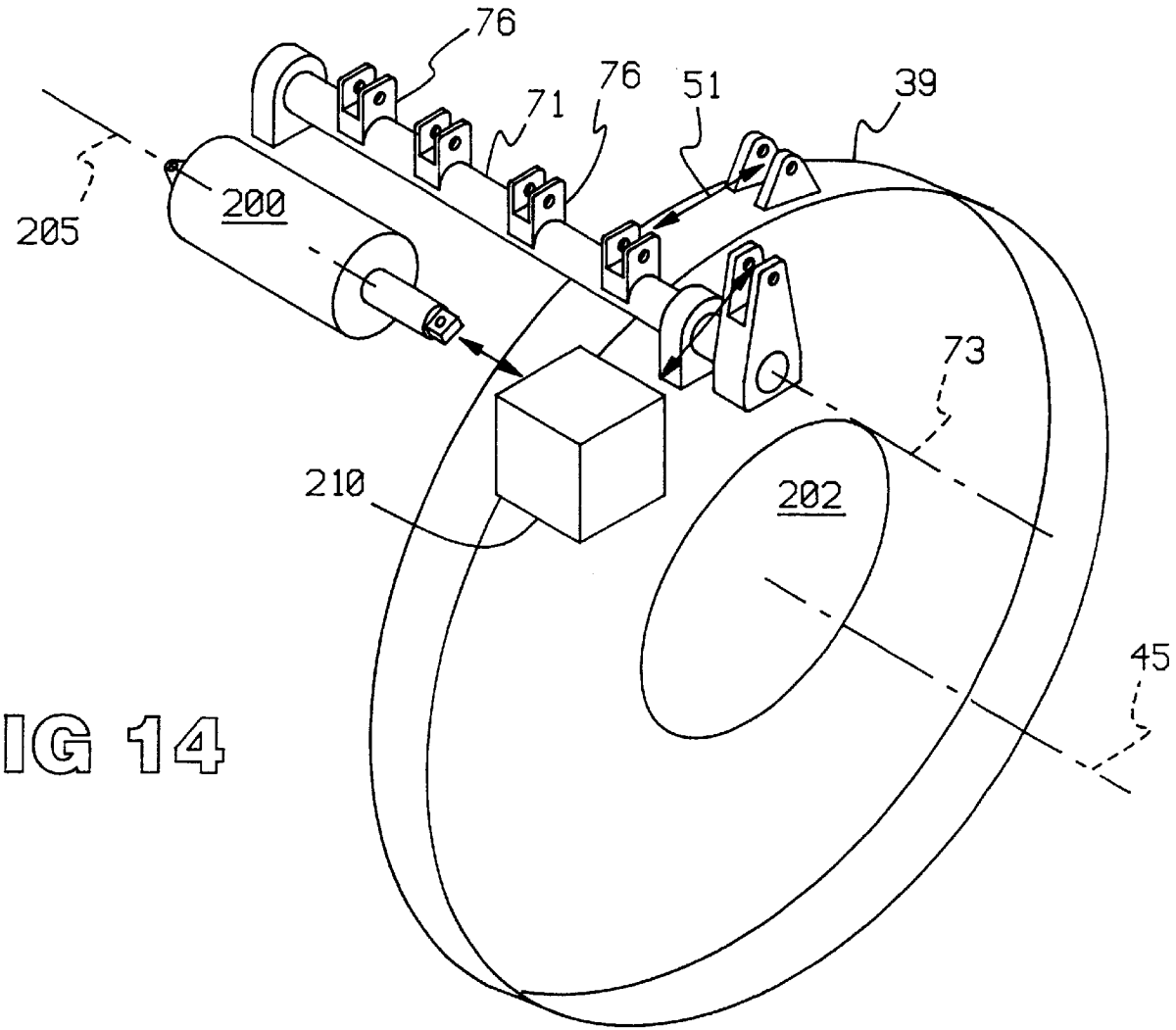
FIG. 14 illustrates one form of the invention.

FIG. 14 illustrates one embodiment of the invention. A linear hydraulic actuator 200 is positioned on a gas turbine engine represented by ellipse 202. The axis-of-motion 205 of the actuator 200 is parallel with the rotational axis 45 of the engine 202.

A torque tube 71 having an axis of rotation 73 is positioned such that axis 73 is parallel with axis 205. The torque tube 71 contains devises 76 which move links, only one 51 of which is shown. Each link 51 controls a ring, only one 39 of which is shown, movement of which changes stator vane angles, through a crank system which is not shown.

Linear motion of the actuator 200 is converted into rotary motion of the torque tube by a converter 210. Numerous types of converter 210 are possible. FIG. 7 illustrates a bell crank. A Scotch Yoke can be used. Gears and pulleys are available.

Figure 16:
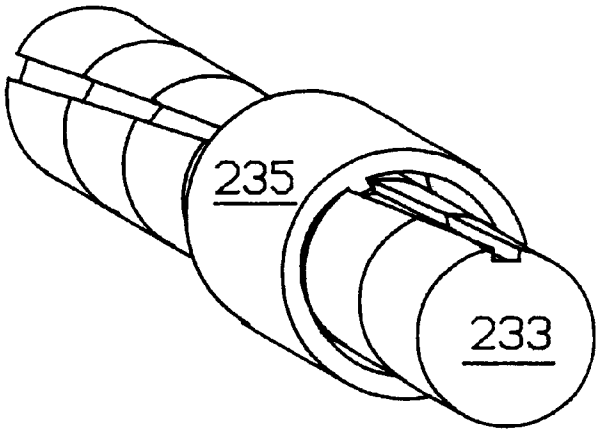
FIGS. 15, 16, and 17 illustrate a mechanism which can replace the bell crank 91 of FIG. 7.
Figure 15:
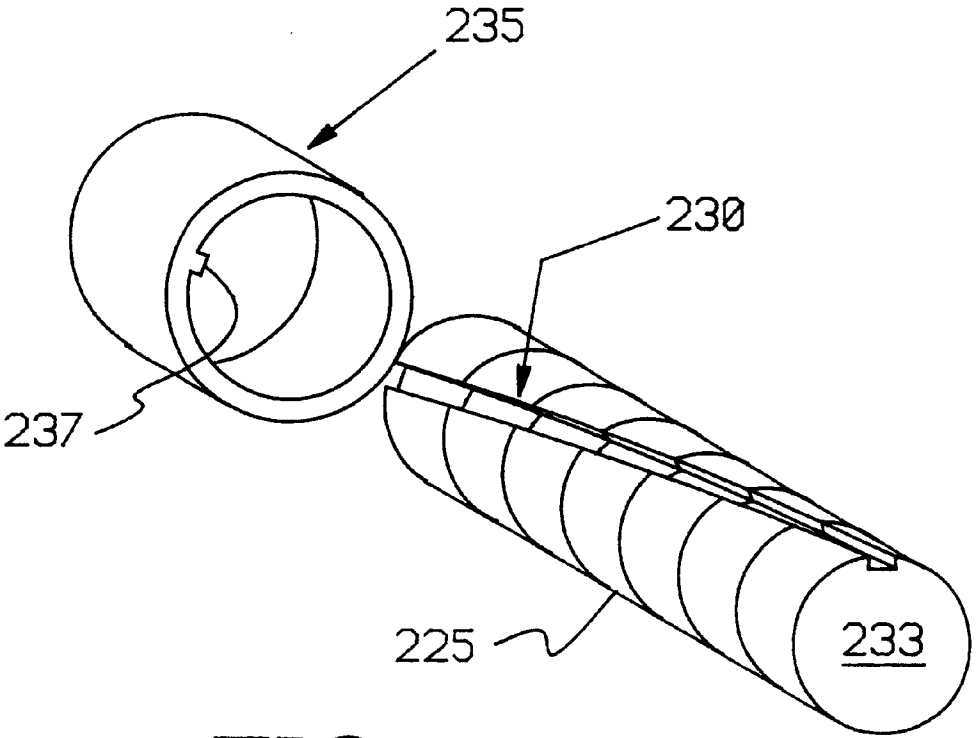
Figure 17:
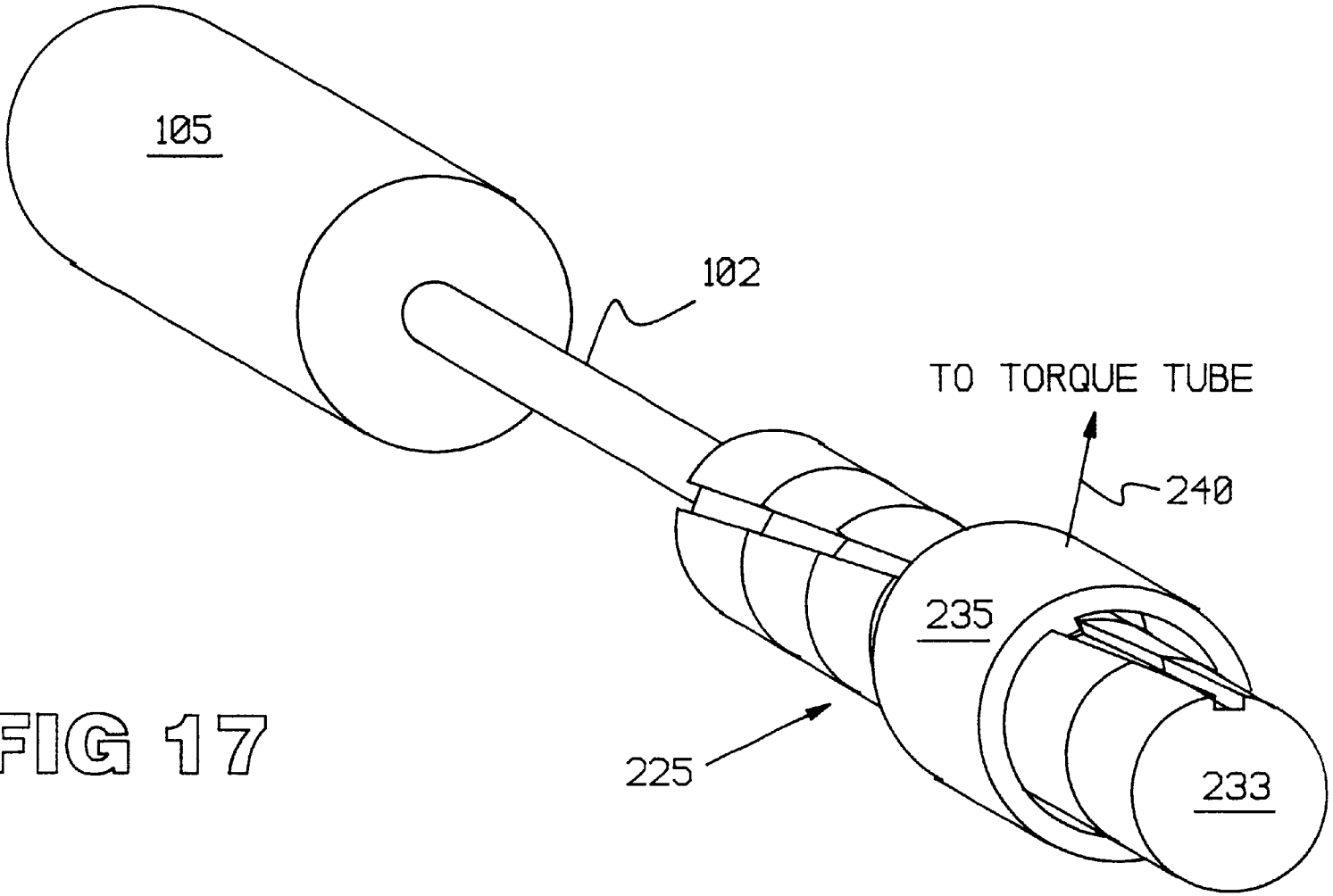

FIGS. 15–17 illustrate another type of linear-rotary converter. In FIG. 15, a cam 225, taking the form of a helical slot 230 in a shaft 233, is shown. A cam follower 235 is shown, wherein a tooth 237 engages the slot 230, as shown in FIG. 16. Cam 225 is constrained against rotation.

Actuator 105 moves the cam 225 in, and out of, the follower 235, to thereby rotate follower 235. Follower 235 is connected to the torque tube (not shown), as indicated by arrow 240 in FIG. 17, by a link, gear, crank, or the like, none of which are shown. In one embodiment, the actuator 105 of FIG. 17 is positioned at location 250 in FIG. 11. The cam 225 and follower 235 are positioned inside the torque tube 71.

Angle 121 in FIG. 10 exists in order to bring the line-of-action of link 93 into alignment with the end of crank 88. That is, if angle 121 were zero, the line-of-action of link 93 would intersect axis 73 of the torque tube 71. No moment arm would exist to rotate the torque tube 71.

Figure 18:
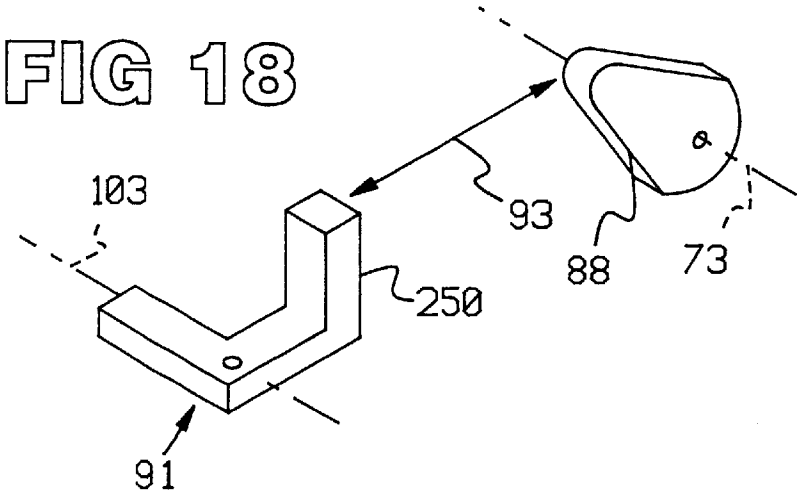
FIGS. 18, 19, 20, and 21 illustrate modifications of the apparatus of FIG. 7.
Figure 19:
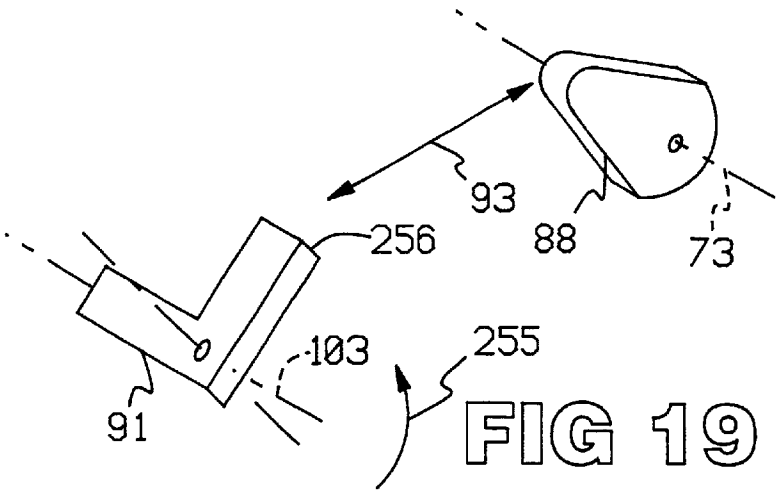

Other approaches are possible to attain a moment arm for the line-of-action of link 93. In FIG. 18, an extension 250 is added to bell crank 91. In FIG. 19, bell crank 91 is rotated as indicated by arrow 255, about axis 103 of rod 102 (not shown), in order to raise the tip 256. That is, tip 256 is thereby moved out of the plane containing axes 73 and 103.

Figure 20:
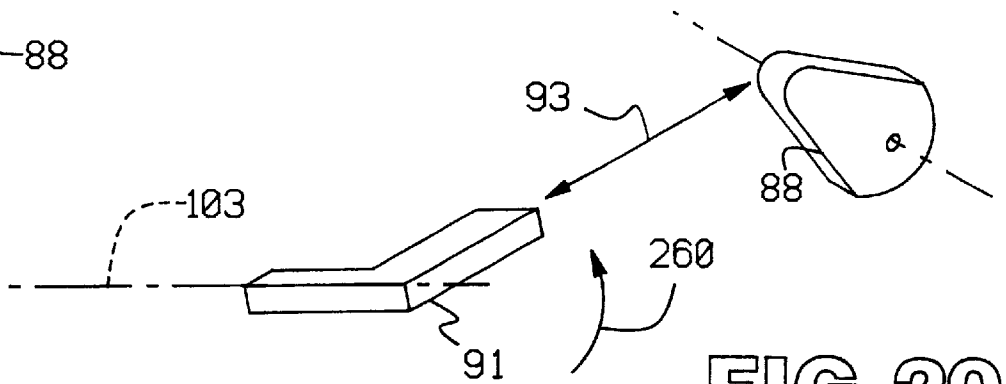
Figure 21:
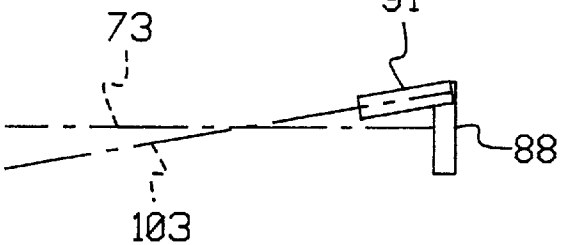

In FIG. 20, axis 103 is rotated, as indicated by arrow 260. This rotation is perhaps seen more clearly in FIG. 21, which is a view seen by eye 265 in FIG. 8. In FIG. 21, axis 103 is rotated counter-clockwise, to thereby raise bell crank 91.

Figure 22:
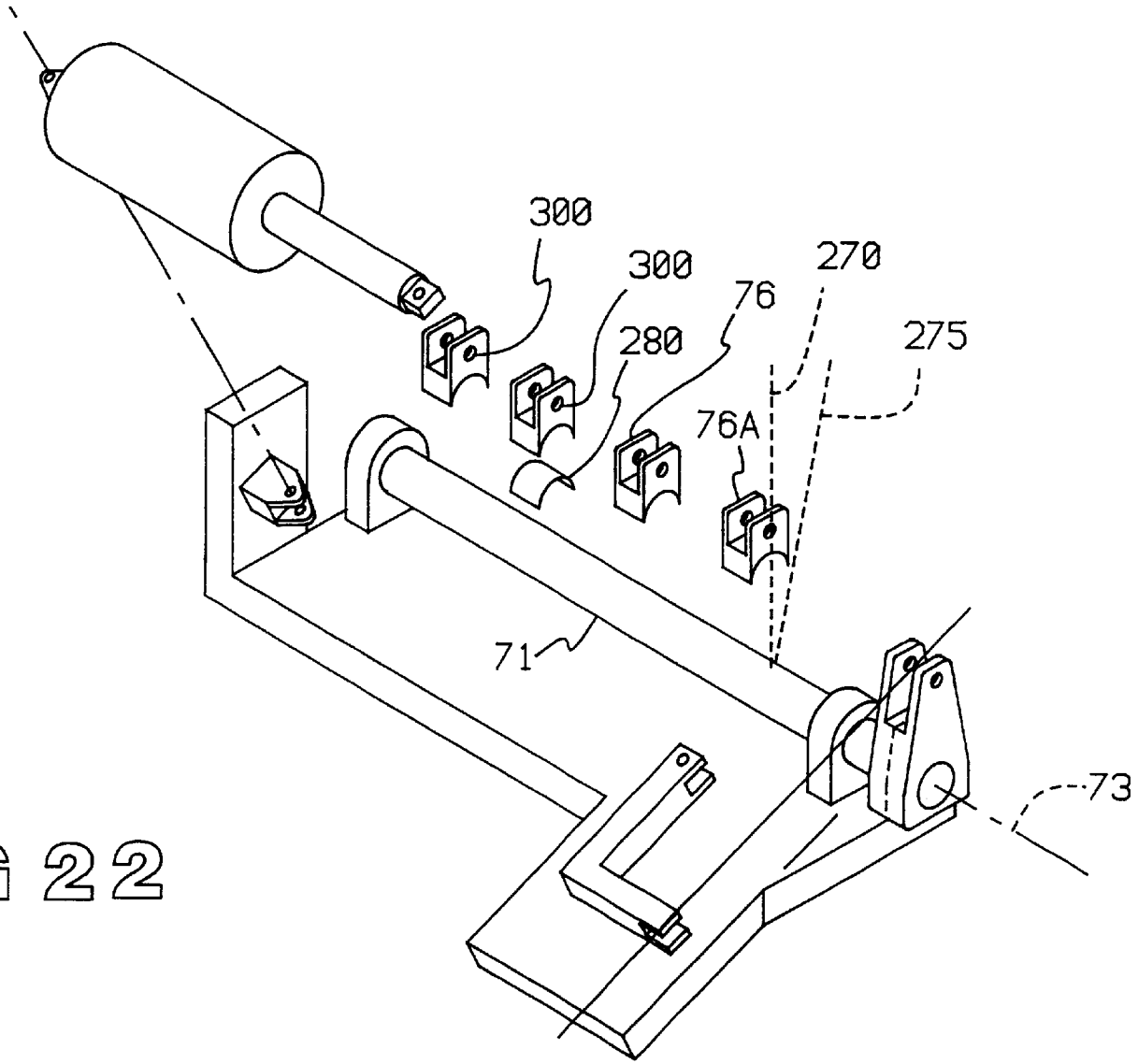

The devises 76 are adjustable as to angular position on the torque tube 71, and adjustable in height. For example, clevis 76A in FIG. 22 can be located as indicated by dashed line 270, or dashed line 275. Placement of different devises at different angular positions on torque tube 71 allows adjustment of the relative phase angles between the rings, such as ring 39 in FIG. 3, which they actuate.

The height adjustment is attained by adding shims 280. Very small adjustments, in the range of 10 mils per shim, are contemplated. The shims increase the radius of curvature of the clevis travel, thereby increasing the amplitude of the swing of the link analogous to link 51 in FIGS. 3 and 4.

Figure 1:
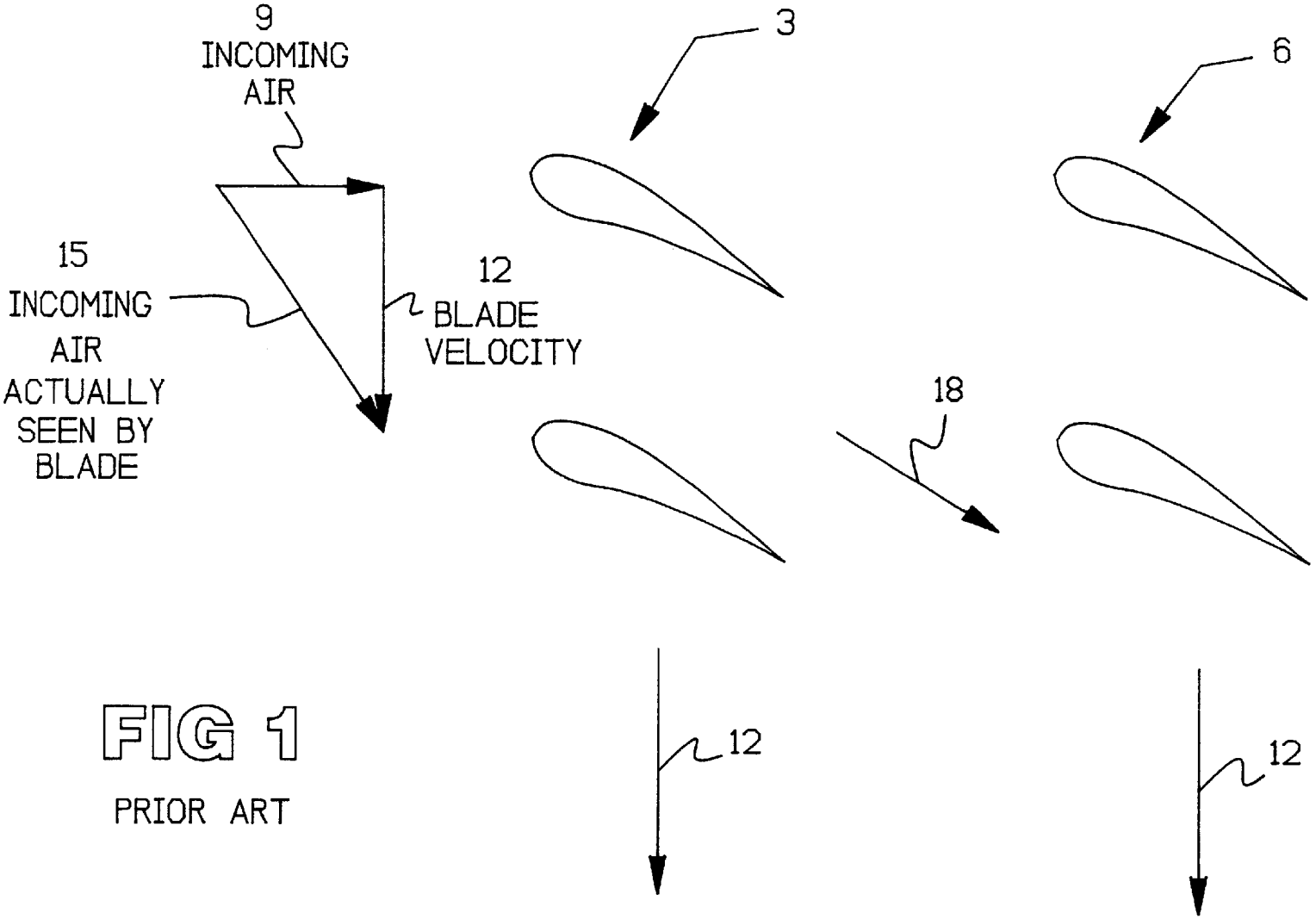
FIG 1 PRIOR ART
FIG. 1 illustrates rotating blades in an axial-flow compressor of a gas turbine engine.
Figure 2:
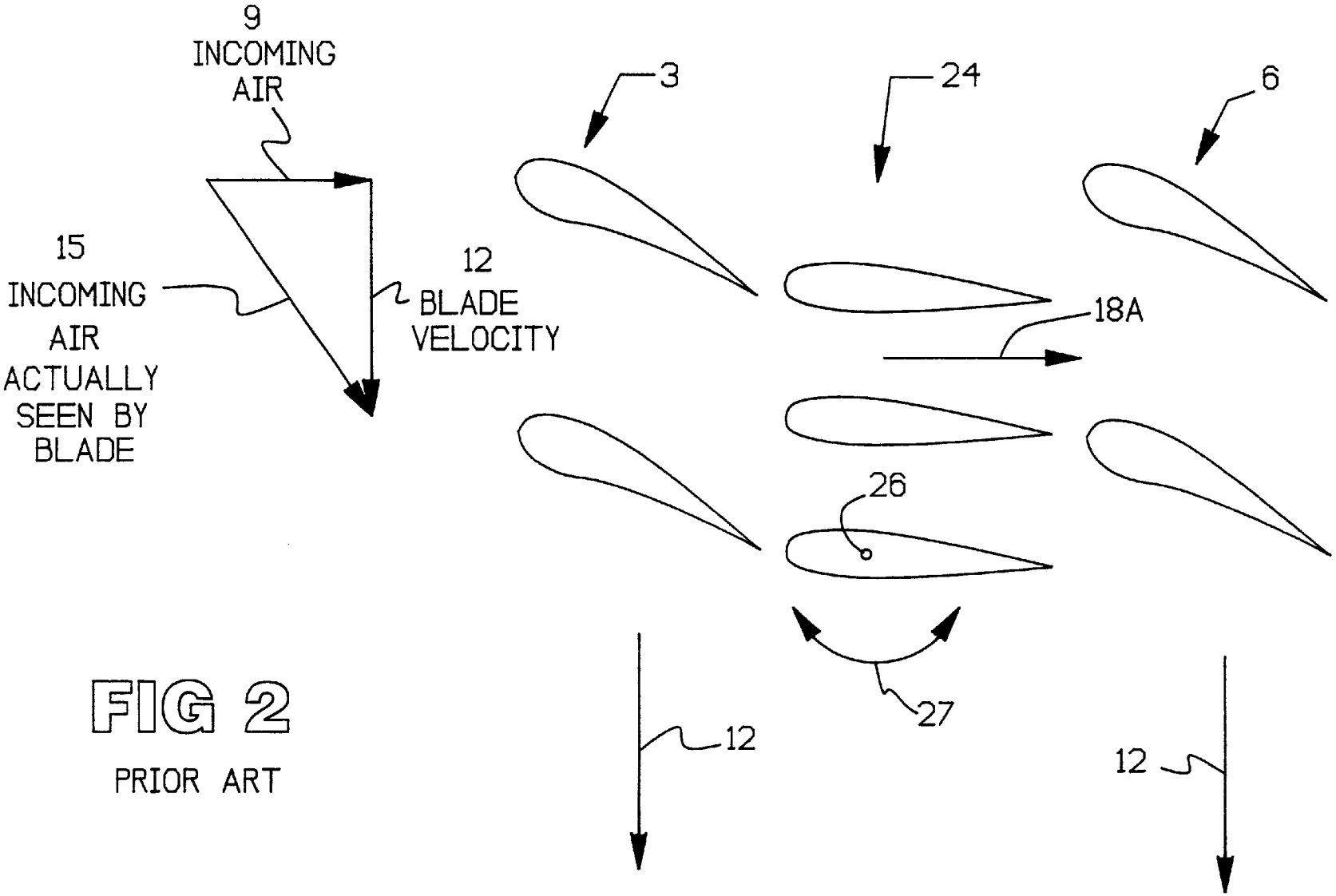
FIG 2 PRIOR ART
FIG. 2 illustrates how stator vanes 24 can adjust the angle-of-attack of air entering the stage of compressor blades 6.
Figure 3:
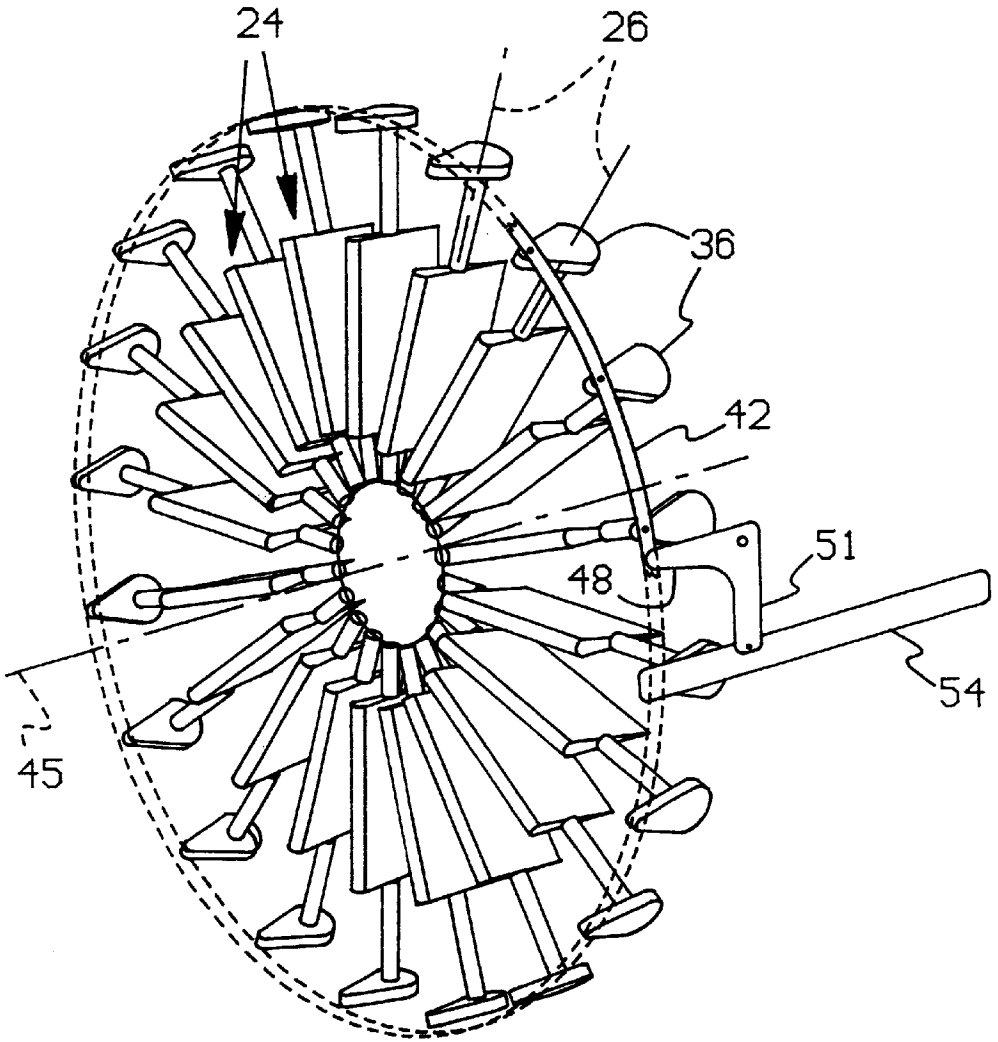
FIG 3 PRIOR ART
FIG. 3 is a simplified perspective view of an array of variable stator vanes.
Figure 4:
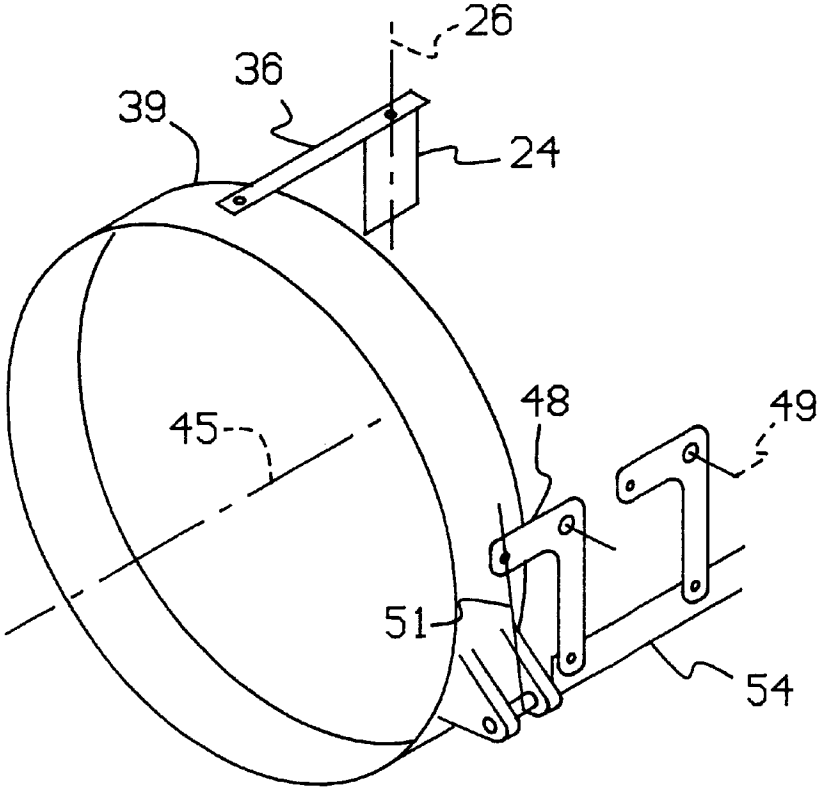
FIG 4 PRIOR ART
FIG. 4 is a simplified representation of part of the apparatus of FIG. 3.
Figure 8:
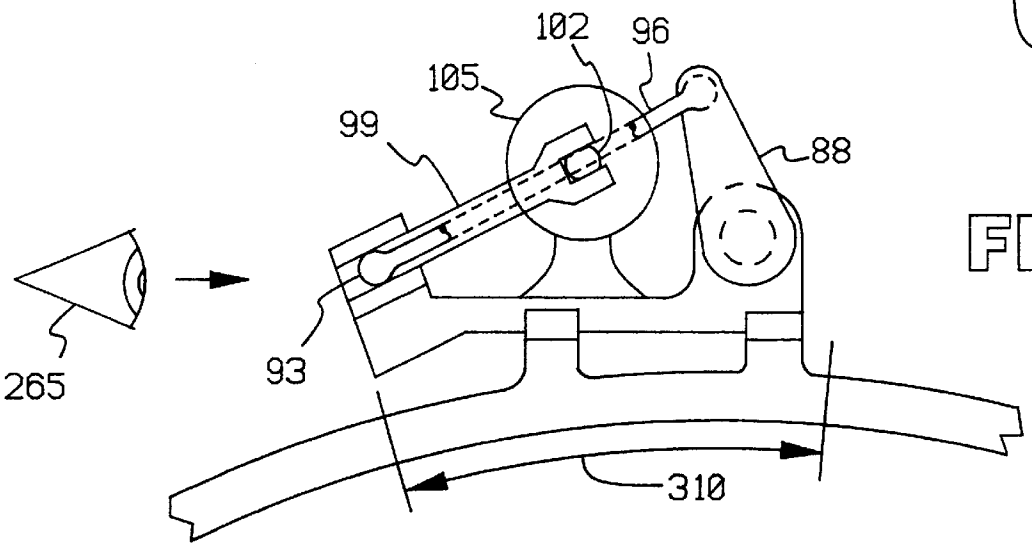
FIG. 8 illustrates a view of the apparatus of FIG. 7, taken along arrows 8-8 in FIG. 7.

The apparatus of FIG. 8 which are contained in the sector 305 include everything needed to adjust links 51 in FIGS. 3 and 4. In the prior art apparatus of FIGS. 3–6, the apparatus needed to adjust links 51 includes the bell cranks 48 and the synchronizing bar 54.

Numerous substitutions and modifications can be undertaken without departing from the true spirit and scope of the invention. I desired to secure Letters Patent on the invention defined in the following claims.

What is claimed is:

1. In a gas turbine engine having an engine axis defined therein, and having multiple rows of variable stator vanes, each row actuated by a respective ring, and each ring actuated by a respective actuation link, an apparatus for actuating the links, comprising:

a) a torque tube having an axis parallel to the engine axis, and bearing a plurality of devises, each connected to a respective actuation link;

b) a linear actuator, having an axis parallel to the engine axis, which actuates the torque tube; and c) a base, removable from the engine, which supports both the torque tube and the actuator.

2. Apparatus for adjusting stator vane angle in a gas turbine engine having an engine axis, comprising:

a) a rotatable torque tube having a tube axis parallel with the engine axis;

b) means for producing changes in stator vane angle in response to rotation of the torque tube;

c) a hydraulic actuator which moves a rod in linear motion, parallel to the tube axis; and d) a convertor which converts the linear motion of the rod to rotary motion of the torque tube.

3. Apparatus according to claim 2, wherein the convertor comprises a bell crank.

4. Apparatus for adjusting stator vane angle in a gas turbine engine having an engine axis, comprising:

a) a rotatable torque tube having a tube axis parallel with the engine axis;

b) means for producing changes in stator vane angle in response to rotation of the torque tube;

c) a hydraulic actuator which moves a rod in linear motion, parallel to the tube axis; and d) a convertor, comprising a cam and follower, which converts the linear motion of the rod to rotary motion of the torque tube.

5. Apparatus, comprising:

a) a torque tube, rotatable about an axis;

b) a linear hydraulic actuator, which moves a rod parallel to said axis;

c) a linkage connecting the rod to the torque tube, causing movement of the rod to rotate the torque tube; and d) one or more linkages linked to the torque tube, each connecting to a respective ring which actuates stator vanes on a gas turbine engine.

6. Apparatus according to claim 5, wherein the linkage comprises e) a bell crank having first and second arms, i) the first arm connecting to the rod, and ii) the second arm connecting to a link which rotates the torque tube when moved.

7. Apparatus mountable to a compressor casing of a gas turbine engine, for actuating adjustable stator vanes, comprising:

a) a torque tube;

b) devises on the torque tube, each for actuating a stage of stator vanes;

c) a hydraulic actuator;

d) a linkage system for connecting the actuator to the torque tube; and e) a base supporting the torque tube, hydraulic actuator, and linkage system.

8. A method of installing an actuator for adjustable stator vanes in a gas turbine engine, comprising:

a) installing an actuator assembly which includes an actuator and a torque tube rotated by the actuator;

b) performing no adjustment of linkages between the actuator and the torque tube; and c) connecting the torque tube to vane linkages which adjust the stator vanes.

9. A method of installing an actuator for adjustable stator vanes in a gas turbine engine, comprising:

a) installing an actuator assembly which includes an actuator and a torque tube rotated by the actuator;

b) performing no adjustment of linkages between the actuator and the torque tube;

c) connecting the torque tube to vane linkages which adjust the stator vanes, and d) adjusting one or more vane linkages.

10. Apparatus for controlling adjustable stator vanes in a gas turbine engine, comprising:

a) a torque tube containing clevises which are connectable to linkages which adjust the stator vanes;

b) a single actuator; and c) a linkage connecting the actuator to the torque tube, which requires no adjustment after the apparatus is connected to the engine.

11. Apparatus according to claim 10, wherein no adjustment is required of the linkage after connection of the apparatus to the engine because adjustment was performed prior to connection.

12. Apparatus according to claim 10, wherein adjustment to the linkage was performed prior to connecting the apparatus to the engine.

13. Apparatus according to claim 10, wherein an axis of rotation is defined in the engine, and the actuator comprises an actuation rod which moves parallel with the axis of rotation.

14. Apparatus according to claim 10, wherein the linkage of paragraph (c) is adjustable.

15. Apparatus according to claim 10, wherein, in normal operation, the actuator, by itself, controls stator vane angle.

16. Apparatus according to claim 10, wherein the linkages of paragraph (a) are non-adjustable.

17. A system, comprising:

a) an axial flow gas turbine (202) engine having an axis of rotation (45);

b) a linear actuator (200) having an axis of movement (205) which is parallel to the axis of rotation (45);

c) a torque tube (71) having a tube-axis (73) which is parallel to both the axis of rotation (45) and the axis of movement (205);

d) a plurality of devises (76) mounted to the torque tube (71);

e) a link (51) linking each clevis (76) to a respective ring (39) which rotates a set of stator vanes (24); and f) means (210) for converting linear movement of the linear actuator (200) to rotary movement of the torque tube, to thereby rotate the rings.

18. System according to claim 17, wherein the means (210) comprises a bell crank (91).

* * * * *